US005361594A

United States Patent [19]

Young

[11] Patent Number: 5,361,594

[45] Date of Patent: Nov. 8, 1994

[54] REFRIGERATION RECOVERY AND PURIFICATION

[76] Inventor: Robert E. Young, 2048 Fallon Dr., Lexington, Ky. 40504

[21] Appl. No.: 166,355

[22] Filed: Dec. 14, 1993

Related U.S. Application Data

[63] Continuation of Ser. No. 989,266, Dec. 11, 1992, abandoned, which is a continuation of Ser. No. 667,695, Mar. 11, 1991, abandoned.

[51] Int. Cl.[5] ..... G01K 13/00

[52] U.S. Cl. ..... 62/129; 62/125; 62/149; 62/292; 62/475

[58] Field of Search ..... 62/77, 85, 149, 195, 62/292, 475, 129, 125, 126

[56] References Cited

U.S. PATENT DOCUMENTS

| | | | |
|---|---|---|---|
| 3,084,523 | 4/1963 | Bottum | 62/296 |
| 3,443,367 | 5/1969 | Bottum | 55/316 |
| 3,487,656 | 1/1970 | Grant | 62/174 |
| 3,643,460 | 2/1972 | Garland | 62/174 |
| 3,699,781 | 10/1972 | Taylor | 62/474 |
| 3,729,949 | 5/1973 | Talbot | 62/149 |
| 3,837,173 | 9/1974 | Kuttruff | 62/128 |
| 3,939,669 | 2/1976 | Schumacher | 62/217 |
| 4,106,306 | 8/1978 | Saunders | 62/149 |
| 4,245,480 | 1/1981 | Saunders | 62/149 |
| 4,261,178 | 4/1981 | Cain | 62/149 |
| 4,266,405 | 5/1981 | Trask | 62/160 |
| 4,364,236 | 12/1982 | Lower | 62/77 |
| 4,401,447 | 8/1983 | Huber | 55/387 |
| 4,441,330 | 4/1984 | Lower | 62/149 |
| 4,463,575 | 8/1984 | McCord | 62/184 |
| 4,474,034 | 10/1984 | Avery | 62/503 |
| 4,476,688 | 10/1984 | Goddard | 62/149 |
| 4,480,446 | 11/1984 | Margulefsky | 62/474 |
| 4,513,578 | 4/1985 | Proctor | 62/149 |
| 4,528,826 | 7/1985 | Avery | 62/503 |
| 4,539,817 | 9/1985 | Staggs | 62/149 |
| 4,601,177 | 7/1986 | Tanino | 62/149 |
| 4,611,473 | 9/1986 | Wada | 62/503 |
| 4,624,112 | 11/1986 | Proctor | 62/149 |
| 4,646,527 | 3/1987 | Taylor | 62/85 |
| 4,688,388 | 8/1987 | Lower | 62/126 |
| 4,714,487 | 12/1987 | Rowles | 62/24 |
| 4,730,465 | 3/1988 | Inoue | 62/503 |
| 4,766,733 | 8/1988 | Scuderi | 62/77 |
| 4,768,347 | 9/1988 | Manz | 62/149 |
| 4,776,174 | 10/1988 | Rich | 62/77 |
| 4,788,833 | 12/1988 | Steele | 62/474 |
| 4,805,416 | 2/1989 | Manz | 62/292 |
| 4,809,515 | 3/1989 | Houwink | 62/149 |
| 4,809,520 | 3/1989 | Manz | 62/292 |
| 4,852,769 | 8/1989 | Robertson et al. | 222/83.5 |
| 4,856,289 | 8/1989 | Lofland | 62/149 |
| 4,856,290 | 8/1989 | Rodda | 62/149 |
| 4,862,699 | 9/1989 | Lounis | 62/84 |
| 4,878,356 | 11/1989 | Punches | 62/149 |
| 4,887,435 | 12/1989 | Anderson | 62/85 |
| 4,903,499 | 2/1990 | Merritt | 62/149 |
| 4,909,042 | 3/1990 | Proctor | 62/149 |
| 4,942,741 | 7/1990 | Hancock | 62/292 |
| 4,967,567 | 11/1990 | Proctor | 62/127 |
| 4,996,848 | 3/1991 | Nelson | 62/77 |
| 5,090,211 | 2/1992 | Peters | 62/149 |
| 5,123,259 | 6/1992 | Morgan, Sr. | 62/292 |
| 5,172,562 | 12/1992 | Manz et al. | 62/149 |

OTHER PUBLICATIONS

Ig-Lo 1500 Refrigerant Reclamation Recharge System Instruction Manual, IG-LO-226 1M Apr. 1991.

Wall Street Journal Article-"Plan to Release CFC Coolants Produces Heat", Sep. 6, 1989.

RSC Magazine, Mar. 1990, "Whirlpool System Uses Plastic Bag to Recover Refrigerants".

*Primary Examiner*—John M. Sollecito

*Attorney, Agent, or Firm*—Sughrue, Mion, Zinn, Macpeak & Seas

[57] ABSTRACT

Refrigerant recovery and purification system optionally capable of drawing a nearly full vacuum on the system to be evacuated and having multi-port valve means for setting to different configurations for different refrigerant processing cycles; e.g., evacuation, deep vacuum, recovery, purification cycle, refrigerant charging, and oil charging, etc. Virgin refrigerant can be inputted from commercial cylinders or from refrigerant cans via a can manifold. Major components comprise: Inlet/outlet means 10, suction accumulator means 20, low-side purifying means (filter dryer) 30, compressor means 40, secondary coil means 70, purifying means (highside) 90, pump-down manifold means 100, storage means 120, oil injection means 140, virgin refrigerant supply means 170 and 180, vacuum pump means 200, and circulation control means 240.

8 Claims, 8 Drawing Sheets

REFRIGERATION RECOVERY AND PURIFICATION

CROSS REFERENCE TO RELATED APPLICATIONS

This is a continuation of application Ser. No. 07/989,266 filed Dec. 11, 1992 now abandoned, which is a continuation of application Ser. No. 07/667,695 filed Mar. 11, 1991 now abandoned.

Cross references to related applications, U.S. Ser. No. 394,594, filed Aug. 16, 1989 (attorney docket 6349AUS), U.S. Ser. No. 371,785, filed Jun. 27, 1989 (attorney docket 6346AUS) U.S. Ser. No. 600,367, filed Oct. 19, 1990 (attorney docket 6346MUS), U.S. Ser. No. 538,639, filed Jun. 13, 1990 (attorney docket 6349MUS), and U.S. Ser. No. 601,838, filed Oct. 18, 1990 (attorney docket 6349NUS) relate to the general field of the present invention.

BACKGROUND OF INVENTION

I. Field of the Invention

The present invention relates to the field of recovery of refrigerants from refrigeration systems which are to be repaired after they are evacuated of refrigerant. These devices are generally classified in U.S. Patent Office Class 62, subclasses 126, 149, 292, 471, 513, and Class 165, subclass 163.

II. Description of the Prior Art

Attempts have been made to produce an effective refrigerant recovery and/or disposal, purification and recharging system. Issued U.S. Patents representative of such known systems are: U.S. Pat. Nos. 3,232,070; 4,285,206; 4,363,222; 4,441,330; 4,476,688; 4,539,817; 4,554,792; 4,646,527; 4,766,733; 4,809,520; and 4,852,769.

None of the prior art references provide the combination of features obtained by the present invention with its ability to recover, purify, recharge, and evacuate, and accept sources of purchased refrigerant, as well.

SUMMARY OF THE INVENTION

I. General Statement of the Invention

According to the present invention, a compressor means 40 and/or a vacuum pump means 200 withdraw refrigerant from a system to be evacuated for repair or other reasons, and discharge it with suitable heat exchange 20/22 to a liquefaction unit which supplies liquid refrigerant to a purification unit 30 & 90, which in turn feeds a refrigerant recharging system 120, 132, 11 capable of receiving refrigerant from storage means 120 or from new containers of newly purchased refrigerant 170. The process being capable of being controlled by valving which alternately switches 256 from the evacuating, purification and admitting of new refrigerant, or optional vacuum pump means 200 for even greater recovery of refrigerant from the system being evacuated.

II. Utility of the Invention

The invention is valuable from both an economic and an ecological standpoint because it recovers refrigerant which is not only valuable, but which has recently been found to deleteriously affect the ozone layer of the earth. The invention can be used for evacuating a wide variety of refrigeration systems, including residential heat pumps, room and central unit air conditioners, refrigerators and freezers, and is especially preferred for evacuation of automotive air conditioning systems.

DESCRIPTION OF THE PREFERRED EMBODIMENTS

Figure 1:
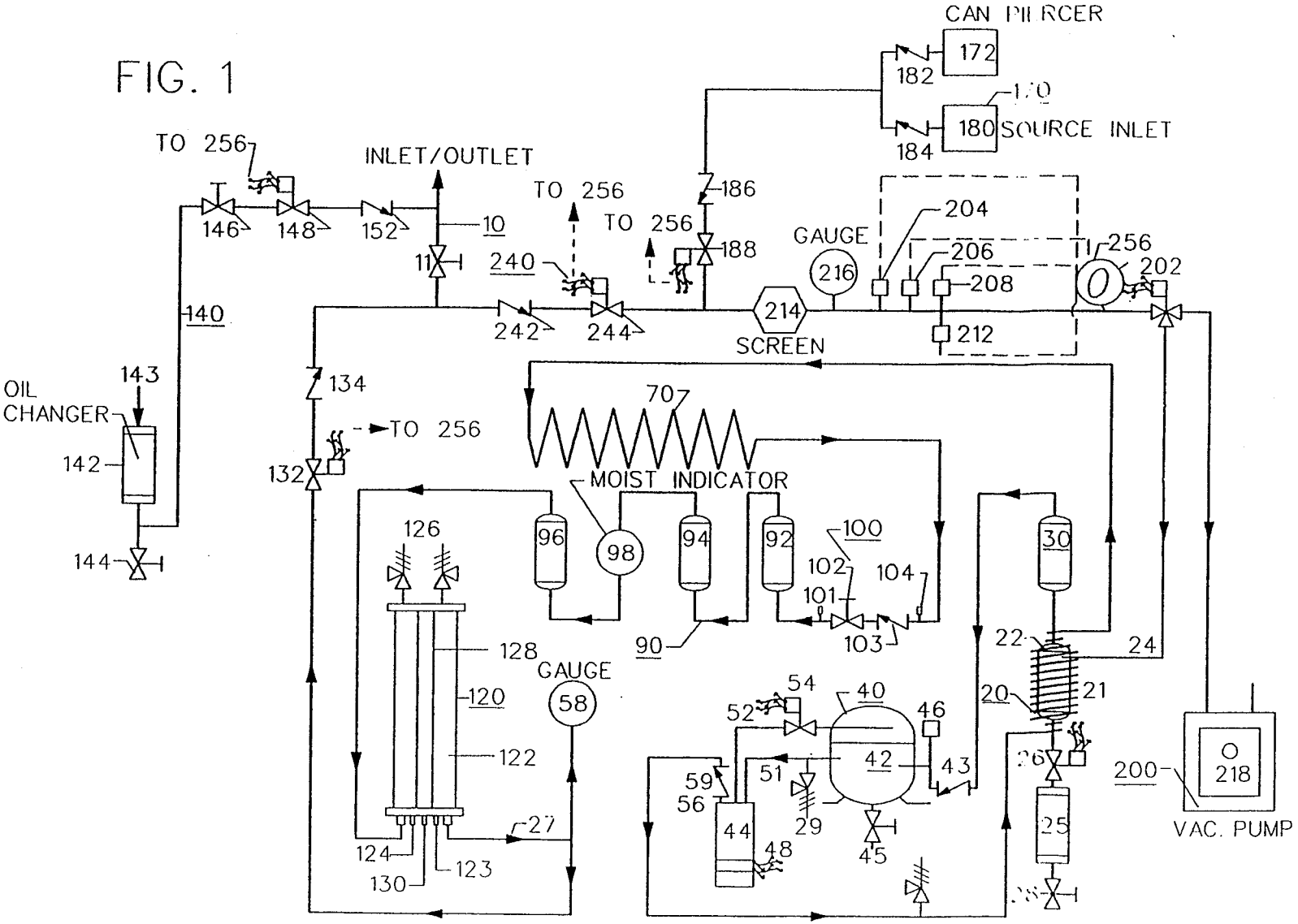
FIG. 1 is a schematic diagram of the system of the invention.
Figure 2A:
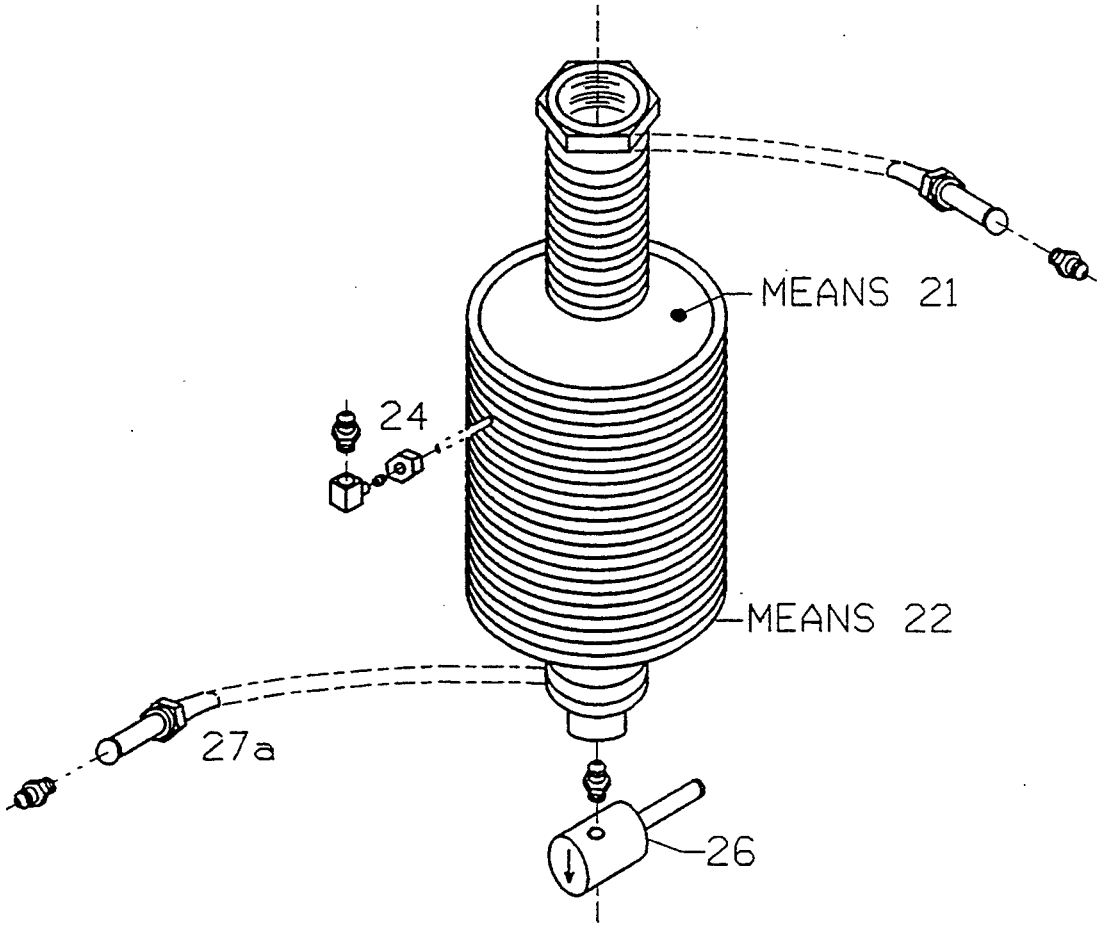
FIG. 2*a* is a detail of a distiller.
Figure 2B:
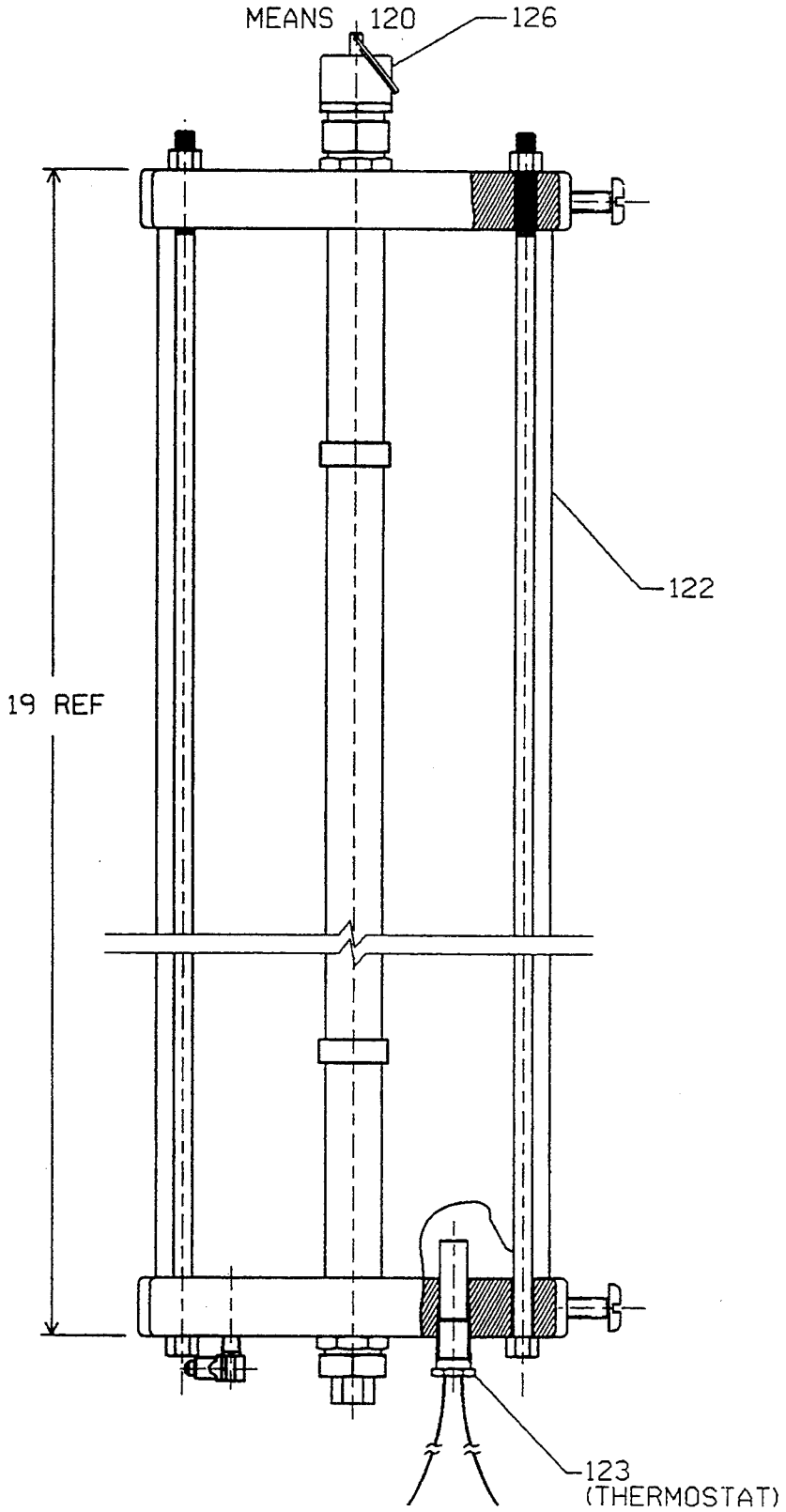
FIGS. 2*b* and 2*c* show a detail of the storage cylinder useful with the invention.
Figure 2C:
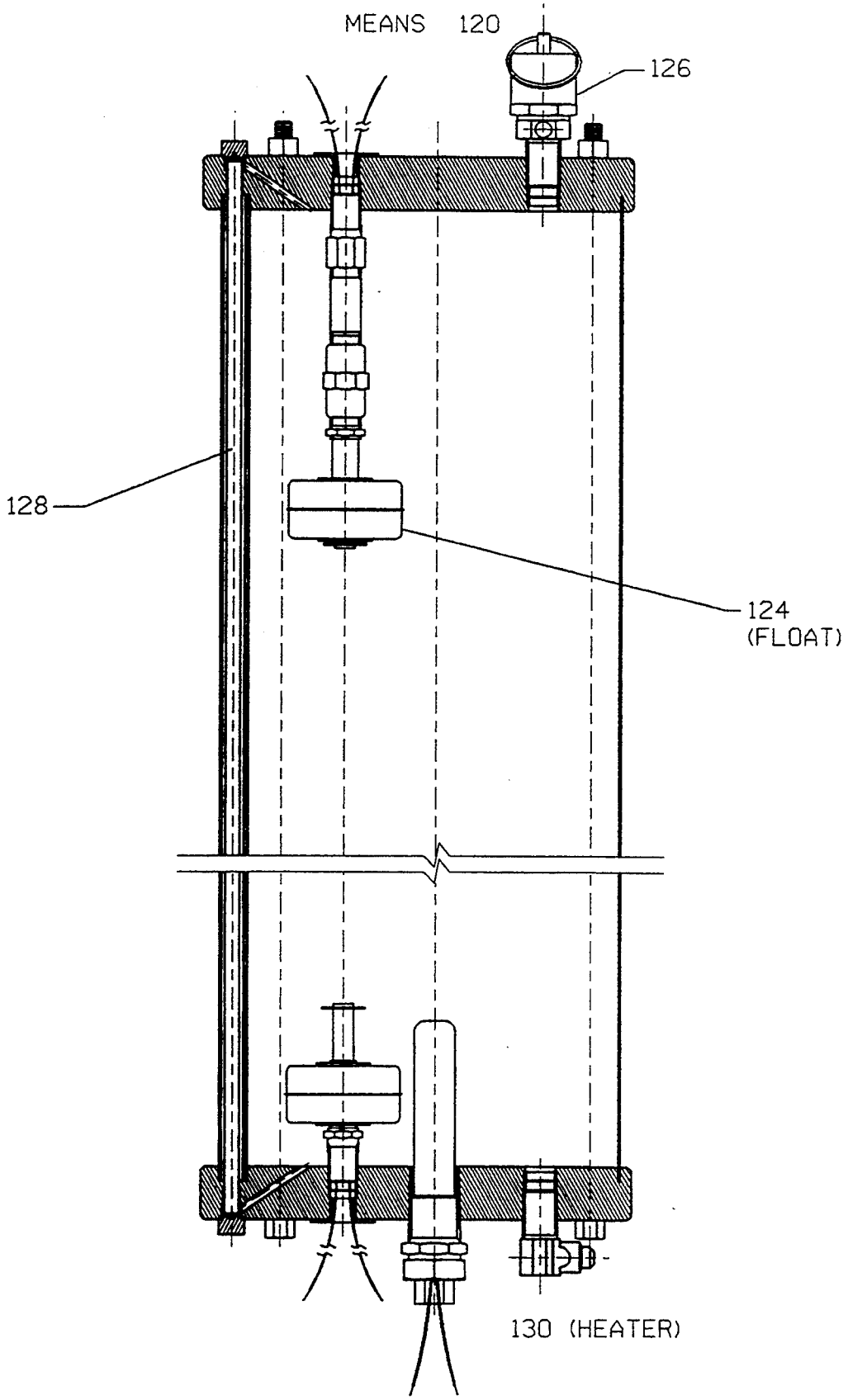
Figure 3:
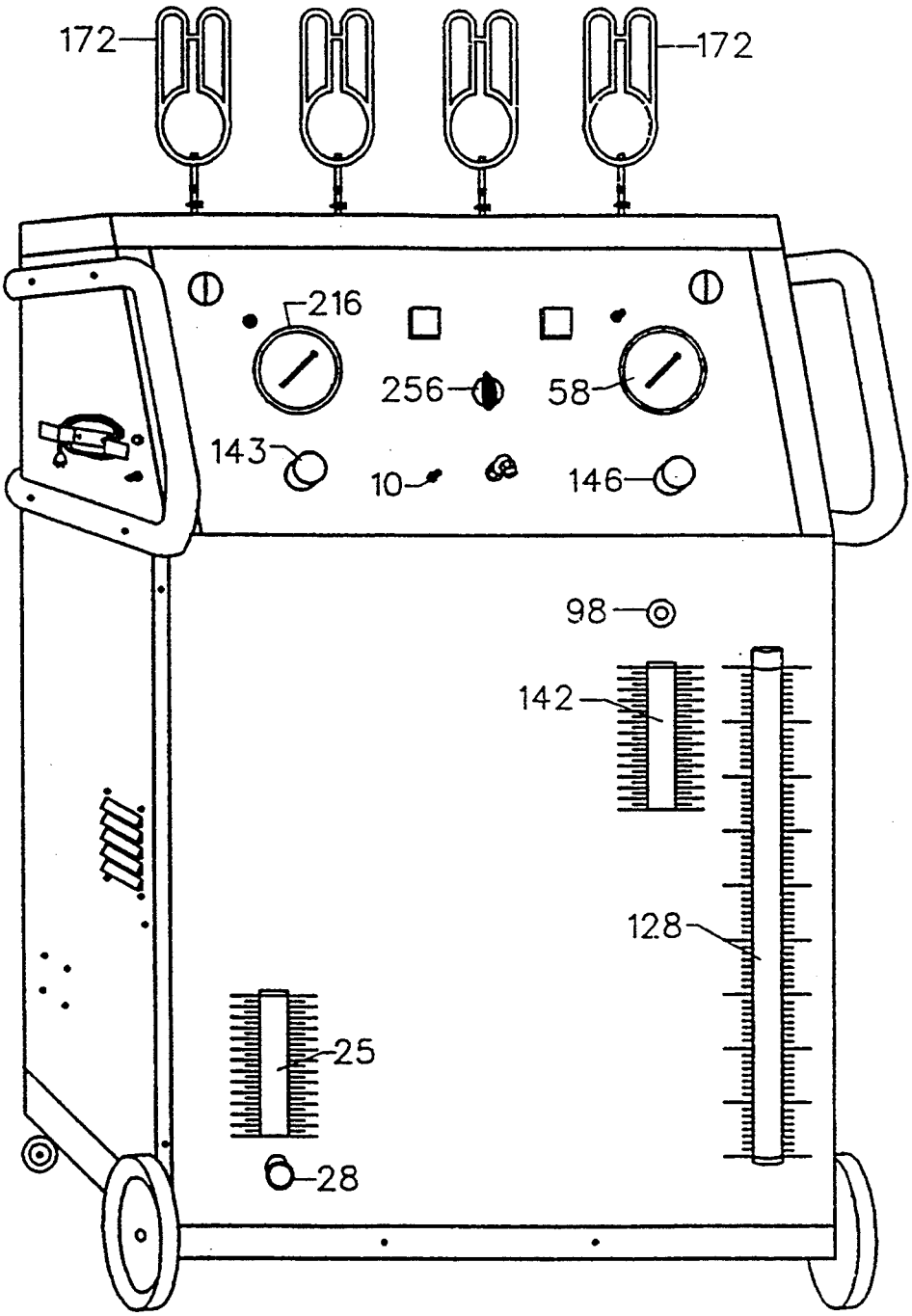
FIG. 3 is a isometric view of the front and one side of an assembled unit according to the invention, showing the gauges, sight glass, electrical controls, and oil addition gauge. Note all expendable parts; e.g., filter dryers are readily accessible by removing the back panel (not shown) without interfering with other components of the system.

Referring to FIG. 1, the principal components of the preferred system of the invention consist of inlet/outlet means 10, suction accumulator means 20, low-side purifying means 30, compressor means 40, secondary coil means 70, purifying means (highside) 90, pump-down manifold means 100, storage means 120 oil injection means 140, virgin refrigerant supply means 170 and 180, vacuum pump means 200, and circulation control means 240. Numerals for these principal components are underlined in FIG. 1.

More specifically referring to the individual components in FIG. 1, inlet/outlet means 10 is connected to suction accumulator means 20, which includes canister means 21 in heat exchange relationship to external coil 22, and side inlet 24 and an oil drain system comprising electric oil dump valve 26 connected to the bottom of canister means 21 and feeding into used oil reservoir 25, which can be drained through valved outlet 28. The top outlet of canister means 21 feeds compressor means 40 through low side purifying means 30. Compressor means 40, includes oil check valve on suction 43 and oil separator 44 with heater 48, which feeds oil back to compressor 42 through solenoid valve 54. Oil separator on return 44 feeds through check valve 59 into "hot gas" external coil 22, as mentioned above. Cooled vapor from external coil 22 is conducted to secondary coil (condenser) means 70 where it is liquified and then passed through highside purifying means 90, which consists of various check valves and manual valves, pump-down manifold 100 and purification filter dryers. Filter dryer 30 (preferably SPORLAN Model 403) filter dryer 92, and filter dryer 94 (preferably both SPORLAN Model 313) with moisture indicator 98 (a moisture indicating sight glass is preferred) indicating the degree of dryness of the refrigerant, followed by a fourth filter dryer 96 (SPORLAN Model 403). The liquid refrigerant then flows into storage means 120 which includes 10-pound cylinder 122, which is fitted with gauge glass 128, and protected by safety/vent valves 126, and which is equipped with float switch 124 and heaters 130, and low-side purifying means, filter dryer 30 (SPORLAN Model 403).

The contents of the 10-pound cylinder 122 can be discharged from storage means 120 via line 27, solenoid valve 132 and check valve 134 into inlet/outlet means 10 to recharge or to flow into a storage cylinder (now shown) is the refrigerant is not needed immediately. When recharging units, oil injection means 140 can be used to add oil to the system being charged. Oil injection means 140 consists of reservoir 142, drain valve 144, hand valve 146, solenoid valve 148, check valve 152 and fill part 143 connected to a standard refrigeration serviceman's gauge (not shown).

As an additional alternative, the contents can be discharged through solenoid valve 132, check valve 134 with hand valve 11 closed so that the refrigerant continues through check valve 242, solenoid valve 244 which is open and through debris screen 214, gauge 216, pressure switch-75 psig 204 (approximately 6 atm). pressure switch-15 psig 206, pressure switch-4" Hg 212 (approximately 6 atm) pressure switch-4 psig 208, (approximately 1.3 atm) through 3-way solenoid valve 202 which directs the flow back through line side inlet 24 into canister means 21 and then back to compressor means 40, to recirculate for additional purification until moisture indicator 98 shows sufficient dryness.

New or previously stored refrigerant can be added through virgin refrigerant supply means 170 which includes can-tapper (detail from U.S. Pat. No. 4,852,769 to Robertson), 30-pound cylinder connection 180, check valve 186, and solenoid valve 188 with 3-way solenoid valve 202 in the position to feed through its side outlet into canister means 21 and then through compressor means 40, external coil 22, secondary coil means 70, highside purifying means 90 and into storage means 120.

With solenoid valve 132 closed, and solenoid valve 244 open, and 3-way solenoid valve 202 set for straight-through flow, vacuum pump means 200 can be used to pull a strong vacuum on the unit which is to be evacuated. This extracts additional moisture which can be vented to the air and/or additional refrigerant which can be (through piping not shown) also recovered and liquified in secondary coil means 70 for reuse.

To maintain oil supply in the compressor, hot gas returns through oil separator 44 which has a ball float switch which opens oil separator 44 to return oil to compressor means 42 when solenoid 54 is opened in response to pressure switch 56 sensing approximately 15 psig atmospheric pressure or more.

To change oil, compressor oil can be drained by opening hand drain valve 45 and new oil added through compressor oil adding port 46.

The invention will be better understood by tracing several of the alternatives:

Simple Evacuation of a System

With solenoid valve 244 open and 3-way solenoid valve 202 set for right-angle flow, refrigerant flows from the system connected to inlet/outlet means 10 through a refrigeration serviceman's gauge set (not shown) into canister means 21 where it is evaporated, with vapor moving through low side purifying means 30 and oil check valve on suction into compressor means 40, with oil being recovered in oil separator 44 and the hot gas is being used to heat canister means 21 by means of external coil 22 (thus partially cooling hot gases) after which the hot gases are cooled in secondary coil means 70 and purified in highside purifier means 90, and moved to storage means 120.

Deep Evacuation

Preferably, the invention includes vacuum pump means having 3-way solenoid valve, and first sensing means to start said vacuum pump means in response to a first internal pressure substantially equal to atmospheric pressure, and second pressure sensing means to stop said vacuum pump means at a substantially lower pressure.

After pressure switch-4" Hg 212 approximately 0.85 atm senses a vacuum, 3-way solenoid valve 202 is actuated to connect vacuum pump means 200 to the system being evacuated until manually shut off when a sufficiently deep vacuum is achieved. Hand valve 11 can then be closed.

Purification Cycle

Three-way solenoid valve 202 can again be set to right-angle flow by turning rotary control switch 256 and the refrigerant from cylinder 122 can be cycled through compressor means 40, having external coil 22, secondary coil means 70, highside purifying means 90, and back to storage means 120. This can be continued until moisture indicator shows a satisfactory moisture level, so that the refrigerant is now suitable for use in recharging other systems. Preferably, rotary control switch 256 connected to is a 3-port 202 valve with the opening and closing configurations for the various ports controlled by multi-position switch 256 which can be set for any of the various cycles as described herein; e.g., refrigerant recovery, purification, oil recovery, deep vacuum, refrigerant charging, oil addition, etc. Multi-position switch 256 can also control the opening and closing of the various other solenoid valves in the system. The switch positions are labeled with the short-names of the cycles so that, in operation, it is merely necessary to turn the switch to the desired cycle, much as one would set an oven on an electric range.

Recharging

A refrigeration system for recharging can be connected through the above serviceman's gauge set (not shown) and valve 11 opened. Vacuum pump means 200 can be used to fully evacuate if necessary. The system can then be recharged from 20-pound cylinder by opening hand valve 11, pressing charging button 13 to open solenoid valve 132. Oil can additionally be added from reservoir by opening hand valve 11 and solenoid valve 148 to measure the desired quantity of oil from sight glass 142 which can be refilled through inlet 143. Refrigerant can be accurately measured by gauge glass 128 which corrects temperature variations and dispenses a pre-measured volume. Alternatively, a 10-pound refrigerant cylinder can be mounted on a load cell so that the refrigerant recharge is measured by weight.

Recharging with Virgin Refrigerant

Solenoid valve 132 and 3-way solenoid valve 202 can both be closed, and hand valve 11 and solenoid valve 244 both opened so the refrigerant flows from virgin refrigerant supply means 170 through 11 which is opened and out through the above refrigerant serviceman's gauge set into the new system. Oil can be added from oil injection means 140 as described previously under "Recharging".

Can Manifold

Figure 4:
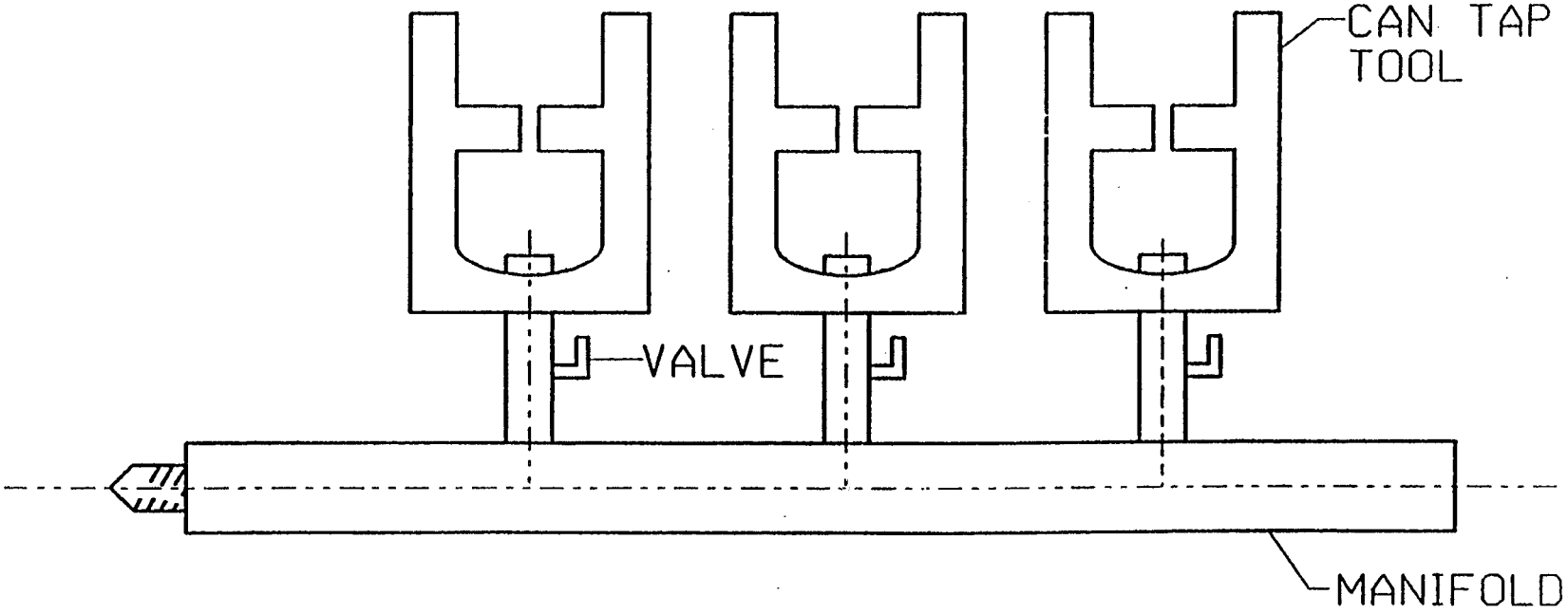
FIG. 4 is a detail of the can-piercing manifold useful as an optional component of the invention.
Figure 5A:
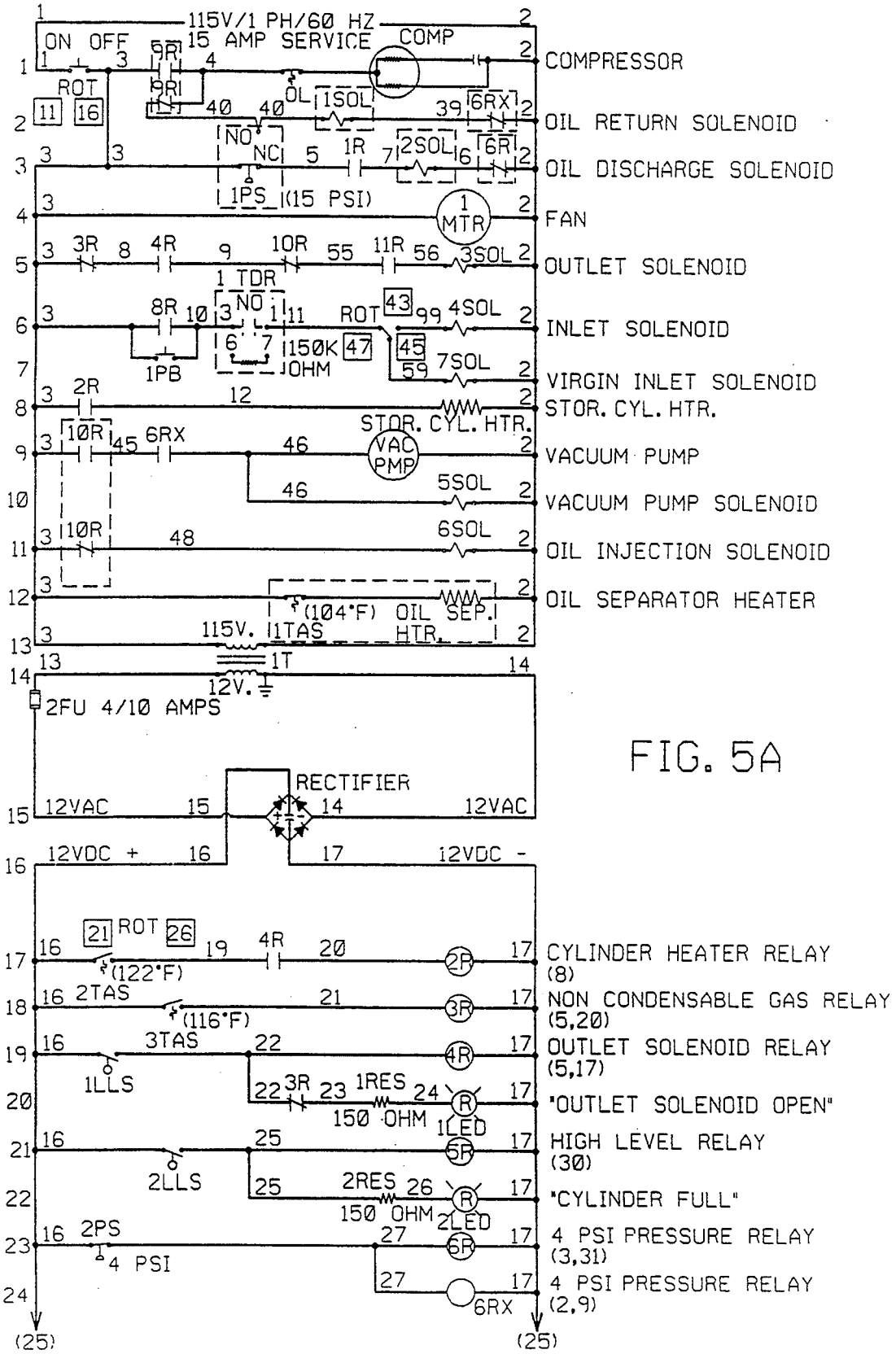
FIG. 5 is a schematic electric circuit diagram.
Figure 5B:
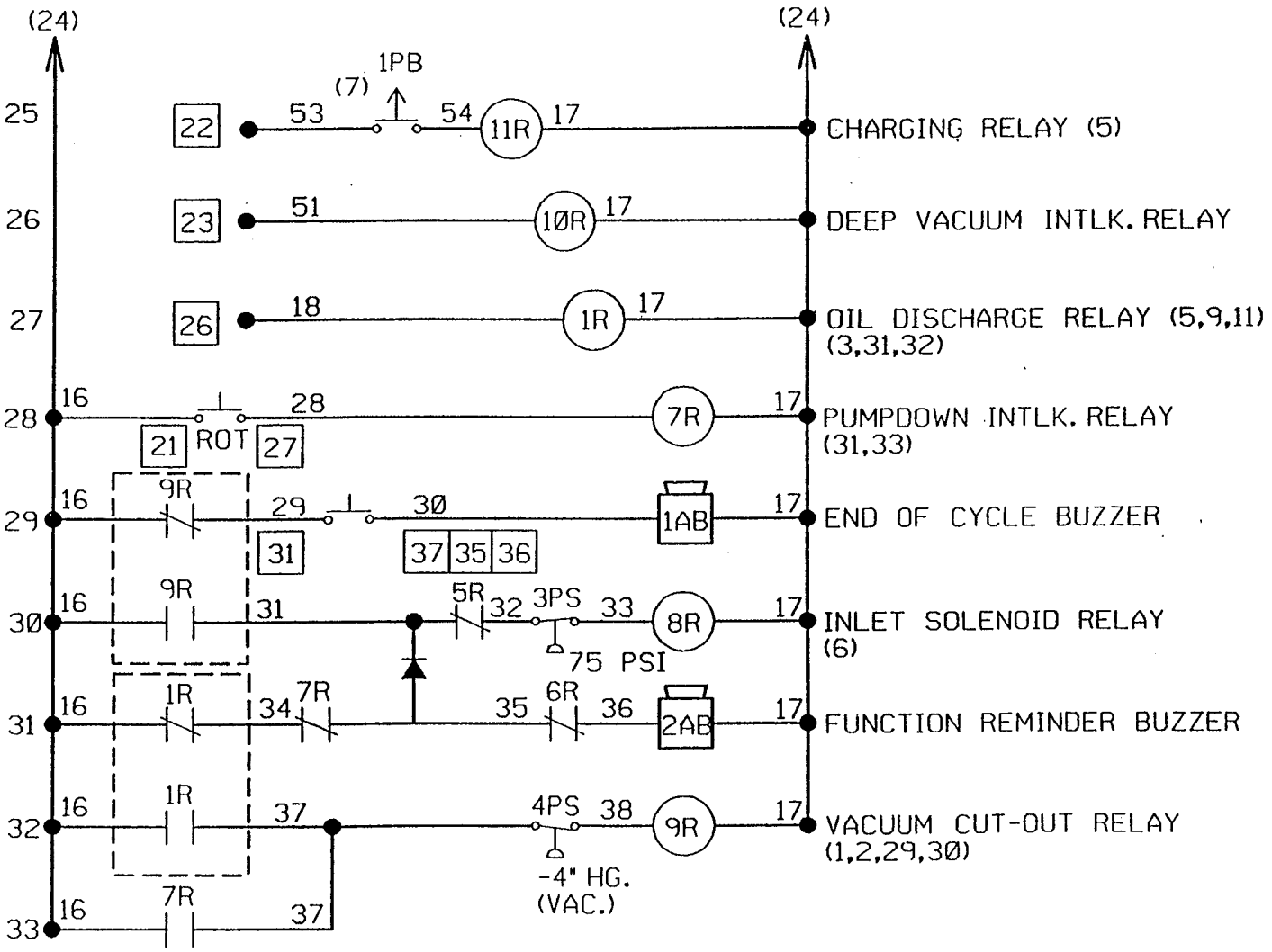

FIG. 4 shows a manifold 172 suitable for tapping into refrigerant cans, a convenient source of virgin refrigerant. Piercing and sealing devices 172 are preferable according to U.S. Pat. No. 4,852,769 to Robertson. Other alternative sources of refrigerant are storage means 120, cylinders filled with recovered and purified refrigerant from the present system, larger disposable containers or refillable refrigerant cylinders, connected to source inlet 180.

Pump-down Cycle for Changing Filter Dryers

Service ports 101 and 104 are preferably schrader valves and can be used to remove all refrigerant from the system prior to replacing any of filter dryers 92, 94, 96 or 30. Port 104 is connected by hose to an external storage cylinder and connect port 101 by hose to service outlet 10. Then compressor 40 can pump all refrigerant into the storage cylinder.

MODIFICATIONS

Specific compositions, methods, or embodiments discussed are intended to be only illustrative of the invention disclosed by this specification. Variations on these compositions, methods, or embodiments are readily apparent to a person of skill in the art based upon the teachings of this specification and are therefore intended to be included as part of the inventions disclosed herein.

Reference to documents made in the specification is intended to result in such patents or literature being expressly incorporated herein by reference including any patents or other literature references cited within such documents.

What is claimed is:

1. An improved apparatus for the recovery, purification and recharging of refrigerant from a refrigeration system, said apparatus comprising in combination:

(a) an inlet/outlet conduit means adapted for two-way flow to or from said refrigeration system;

(b) a suction accumulation means;

(c) a compressor means;

(d) a secondary coil means;

(e) a highside-purifying means;

(f) a storage means adapted for recharging said system with a measured charge of liquid refrigerant;

(g) a vacuum pump means;

(h) conduit means for connecting said inlet/outlet means, said suction accumulator means, said compressor means, said secondary coil means, said highside-purifying means, and said storage means in series and in order, said conduit means including a plurality of solenoid control valves for selectively controlling refrigerant flow therethrough from said inlet/outlet to said storage means;

(i) said conduit means further including a 3-way solenoid valve means for alternately connecting said inlet/outlet means to said vacuum pump means;

(j) a first pressure sensing means for sensing a first internal pressure within said inlet/outlet means substantially equal to atmospheric pressure for controlling start-up of said vacuum pump means;

(k) a second pressure means for sensing a substantially lower pressure in said inlet/outlet means for controlling stoppage of said vacuum pump means;

(l) a multi-position switch means operatively coupled to said plurality of solenoid valves for controlling said solenoid valves and said 3-way solenoid valve to selectively operate said apparatus in one of a refrigerant recovery mode, a refrigerant recirculating mode through the high-side purifying means, and evacuating mode by said vacuum pump in response to operation of said first and second pressure sensing means, and a recharging mode of said refrigeration system, and wherein said suction accumulation means includes an external coil in heat exchange therewith and wherein said secondary coil means and said external coil operate without a fan.

2. An apparatus according to claim 1, wherein said secondary coil is connected to receive and condense at least a portion of refrigerant from said external coil.

3. An apparatus according to claim 1 additionally comprising a heater (130) in said storage means (120), controlled by a thermostat (123).

4. An apparatus according to claim 1 wherein said high-side purifying means additionally comprises a moisture indicator (98) to indicate dryness of the refrigerant.

5. An apparatus according to claim 1 further comprising a low-side purifying means (30) within said conduit means upstream of said secondary coil means.

6. An improved apparatus for the recovery, purification and recharging of refrigerant and oil from and to a refrigeration system, said apparatus comprising in combination:

A. a portable cabinet having a front panel and a removable back panel, and having mounted on or within said cabinet: inlet/outlet means (10), suction accumulator means (20), low-side purifying means (30), compressor means (40), secondary coil means (70), high-side purifying means (90), pump-down manifold means (100), storage means (120), oil injector means (140), virgin refrigerant supply means (170) and (180), vacuum pump means (200), and circulation control means (240), said apparatus further comprising in combination, the following elements in fluid communication:

(a) an inlet/outlet conduit means adapted for two-way flow to or from said refrigeration system and connected upstream of (b) a suction accumulation means upstream of (c) a compressor means upstream of (d) an external coil means said suction accumulation means including an external coil means, said external coil means being connected to said secondary coil on its outlet and to a compressor outlet on its inlet, said external coil means being connected upstream of (e) a highside-purifying means upstream of (f) a storage means adapted for recharging said system with a measured charge of refrigerant, (g) a vacuum pump means having a 3-way solenoid valve means for selectively connecting said inlet/outlet means to said vacuum pump means and to communicate said refrigerant system with said suction accumulator means;

(h) a first pressure sensing means for sensing a first internal pressure within said inlet/outlet means substantially equal to atmospheric pressure to control starting of said vacuum pump means; and (i) a second pressure sensing means for sensing a substantially lower pressure in said inlet/outlet means to control stoppage of said vacuum pump means;

(j) a plurality of solenoid valves for controlling circulation of said refrigerant from said inlet/outlet conduit to said storage means and from said inlet/outlet conduit to said vacuum pump means, and a multi-position switch operatively connected to and controlling said plurality of solenoid valves and said 3-way solenoid valve to operate said apparatus under various cycles in a selected one of a refrigerant recovery mode, a refrigerant circulating mode through the high-side purifying means, and evacuating mode by said vacuum pump, and a recharging mode of said refrigeration system;

wherein the following are mounted on said front panel;

(1) a gauge glass (128) connected to said storage means (120) to show a level of said refrigerant in said storage means;

(2) means for indicating an oil level in an oil recharging reservoir (142);

(3) means for indicating a level of used oil in a used oil reservoir (25);

(4) a low-side pressure gauge (216);

(5) a pressure gauge (58) for indicating pressure in said storage means (120);

and wherein a sight glass, electrical control means, an oil addition gauge, and said purifying means comprised of filter dryers are mounted internally of said portable cabinet and accessible by removal of said back panel without interfering with other components of the system.

7. An apparatus according to claim 6 wherein said multi-position switch has labeled positions with indications of said cycles, and wherein said cycles comprise at least two of the following: a refrigerant recovery cycle, a purification cycle, an oil recovery cycle, a deep vacuum cycle, a refrigerant charging cycle, and an oil addition cycle.

8. An improved apparatus for the recovery, purification and recharging of refrigerant from a refrigeration system, said apparatus comprising in combination:

(a) an inlet/outlet conduit means adapted for two-way flow to or from said refrigeration system;

(b) a suction accumulation means;

(c) a compressor means;

(d) a secondary coil means;

(e) a highside-purifying means;

(f) a storage means adapted for recharging said system with a measured charge of liquid refrigerant;

(g) a vacuum pump means;

(h) conduit means for connecting said inlet/outlet means, said suction accumulator means, said compressor means, said secondary coil means, said highside-purifying means, and said storage means in series and in order, said conduit means including a plurality of solenoid control valves for selectively controlling refrigerant flow therethrough from said inlet/outlet to said storage means;

(i) said conduit means further including a 3-way solenoid valve means for alternately connecting said inlet/outlet means to said vacuum pump means;

(j) a first pressure sensing means for sensing a first internal pressure within said inlet/outlet means substantially equal to atmospheric pressure for controlling start-up of said vacuum pump means;

(k) a second pressure means for sensing a substantially lower pressure in said inlet/outlet means for controlling stoppage of said vacuum pump means; and (l) a multi-position switch means operatively coupled to said plurality of solenoid valves and said 3-way solenoid valve for controlling said solenoid valves to selectively operate said apparatus in one of a refrigerant recovery mode, a refrigerant recirculating mode through the highside purifying means, an evacuating mode by said vacuum pump in response to operation of said first and second pressure sensing means, and a recharging mode of said refrigeration system; and wherein said suction accumulator means external coil is connected to said secondary coil at the outlet and to the compressor outlet at the inlet of said external coil.

* * * * *